US009810243B2

(12) United States Patent
Terao et al.

(10) Patent No.: US 9,810,243 B2
(45) Date of Patent: Nov. 7, 2017

(54) SWITCHING VALVE

(71) Applicant: KAYABA INDUSTRY CO., LTD., Tokyo (JP)

(72) Inventors: Takeshi Terao, Kanagawa (JP); Masayuki Nakamura, Kanagawa (JP)

(73) Assignee: KYB Corporation, Tokyo (JP)

( * ) Notice: Subject to any disclaimer, the term of this patent is extended or adjusted under 35 U.S.C. 154(b) by 347 days.

(21) Appl. No.: 14/407,981

(22) PCT Filed: Aug. 9, 2013

(86) PCT No.: PCT/JP2013/071662
§ 371 (c)(1),
(2) Date: Dec. 15, 2014

(87) PCT Pub. No.: WO2014/027621
PCT Pub. Date: Feb. 20, 2014

(65) Prior Publication Data

US 2015/0167699 A1 Jun. 18, 2015

(30) Foreign Application Priority Data

Aug. 15, 2012 (JP) ..... 2012-180235

(51) Int. Cl.
*F15B 11/024* (2006.01)
*F15B 13/04* (2006.01)
(Continued)

(52) U.S. Cl.
CPC ..... *F15B 11/024* (2013.01); *E02F 9/2217* (2013.01); *F15B 13/0403* (2013.01);
(Continued)

(58) Field of Classification Search
CPC ..... F15B 11/024; F15B 2011/0243; F15B 2011/0246
See application file for complete search history.

(56) References Cited

U.S. PATENT DOCUMENTS 5,022,434 A 6/1991 Tsukimoto
5,161,575 A 11/1992 Morikawa et al.
(Continued)

FOREIGN PATENT DOCUMENTS

JP 55-051104 A 4/1980
JP 2-101179 U * 2/1990
(Continued)

*Primary Examiner* — F. Daniel Lopez
(74) *Attorney, Agent, or Firm* — Rabin & Berdo, P.C.

(57) ABSTRACT

A switching valve includes a spool, a first cylinder port that communicates with the piston side chamber, a second cylinder port that communicates with the rod side chamber, a bridge passage having a first opening which is adjacent to the first cylinder port and a second opening which is adjacent to the second cylinder port, a regeneration passage formed in the spool to connect the second cylinder port communicating with the rod side chamber to the first cylinder port in accordance with a switching position of the spool, and a first communication port and a second communication port formed in the spool to communicate with the regeneration passage. The first communication port communicates with the second opening of the bridge passage, which is adjacent to the second cylinder port, and the second communication port communicates with the second cylinder port in accordance with the switching position of the spool.

8 Claims, 7 Drawing Sheets

(51) Int. Cl.

| | |
|---|---|
| ***E02F 9/22*** | (2006.01) |
| ***F15B 21/14*** | (2006.01) |
| *F15B 13/02* | (2006.01) |

(52) U.S. Cl.
CPC ..... *F15B 21/14* (2013.01); *F15B 13/021* (2013.01); *F15B 2011/0246* (2013.01)

(56) References Cited

U.S. PATENT DOCUMENTS

| | | | | |
|---|---|---|---|---|
| 5,862,831 | A * | 1/1999 | Chung ..... | F15B 11/024 137/596.2 |
| 2006/0081299 | A1 | 4/2006 | Koo et al. | |

FOREIGN PATENT DOCUMENTS

| | | | |
|---|---|---|---|
| JP | 4-31302 | * | 3/1992 |
| JP | 04-351384 | A | 12/1992 |
| JP | 2001-304202 | A | 10/2001 |
| JP | 2006-112619 | A | 4/2006 |

* cited by examiner

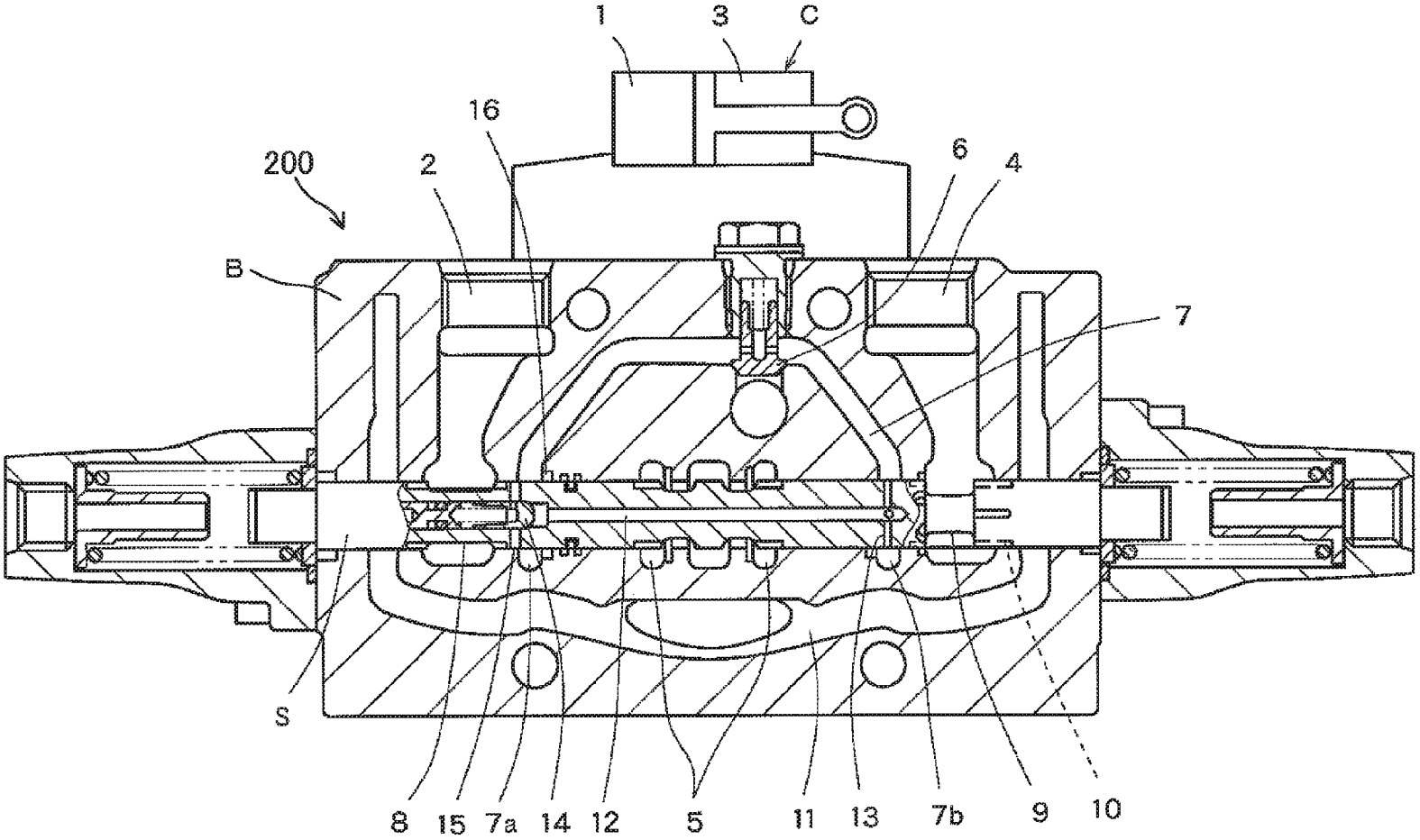
FIG. 7 COMPARATIVE EXAMPLE

SWITCHING VALVE

TECHNICAL FIELD

The present invention relates to a switching valve having a regeneration mechanism that regenerates return fluid flowing out of a rod side chamber of a cylinder to a piston side chamber.

BACKGROUND ART

JP2001-304202A describes this type of switching valve.

JP2001-304202A discloses a switching valve including a spool that operates a cylinder by controlling a direction of working oil supplied from a pump, and has an internally formed regeneration passage through which return oil flowing out of a rod side of the cylinder is regenerated to a piston side chamber.

Further, the regeneration passage of the switching valve disclosed in JP2001-304202A includes a radial direction hole capable of communicating with upper and lower working oil supply/discharge grooves positioned at a first end of the spool, an axial direction hole that communicates with the radial direction hole, and a radial direction hole that communicates with the axial direction hole and communicates with upper and lower working oil supply/discharge grooves positioned at a second end of the spool. The return oil flowing out of the rod side of the cylinder is regenerated to the piston side chamber through the radial direction hole in the second end, the axial direction hole, and the radial direction hole in the first end.

SUMMARY OF INVENTION

In this type of switching valve, restrictions apply to a sectional area and so on of the spool, making it difficult to increase a diameter of the regeneration passage. The spool is formed with the radial direction holes and peripheral grooves formed in an outer periphery thereof, and therefore, when the diameter of the regeneration passage is increased, a sectional area of a part for forming the radial direction holes and so on decreases, leading to a strength deficiency. In a case where it is difficult to increase the diameter of the regeneration passage in this manner, pressure loss in the fluid passing through the regeneration passage increases, leading to a corresponding increase in a pressure in a rod side chamber. When the pressure in the rod side chamber increases, a pressure in the piston side chamber also increases, and therefore a discharge pressure of a pump must be increased correspondingly. As a result, an increase in energy consumption occurs.

An object of the present invention is to provide a switching valve with which pressure loss in a regeneration passage can be reduced, enabling a reduction in energy consumption.

According to one aspect of the present invention, a switching valve that switches between supply and discharge of a working fluid to and from a cylinder having a piston side chamber and a rod side chamber, includes a spool incorporated into a valve body to be free to slide, a first cylinder port that communicates with the piston side chamber, a second cylinder port that communicates with the rod side chamber, a bridge passage having a pair of openings, a first opening of which is adjacent to the first cylinder port and a second opening of which is adjacent to the second cylinder port, a regeneration passage formed in the spool to connect the second cylinder port communicating with the rod side chamber to the first cylinder port in accordance with a switching position of the spool, and a first communication port and a second communication port formed in the spool to communicate with the regeneration passage. The first communication port communicates with the second opening of the bridge passage, which is adjacent to the second cylinder port, and the second communication port communicates with the second cylinder port in accordance with the switching position of the spool.

BRIEF DESCRIPTION OF DRAWINGS

FIG. 7 is a sectional view showing a switching valve according to a comparative example of the present invention.

DESCRIPTION OF EMBODIMENTS

Figure 1:
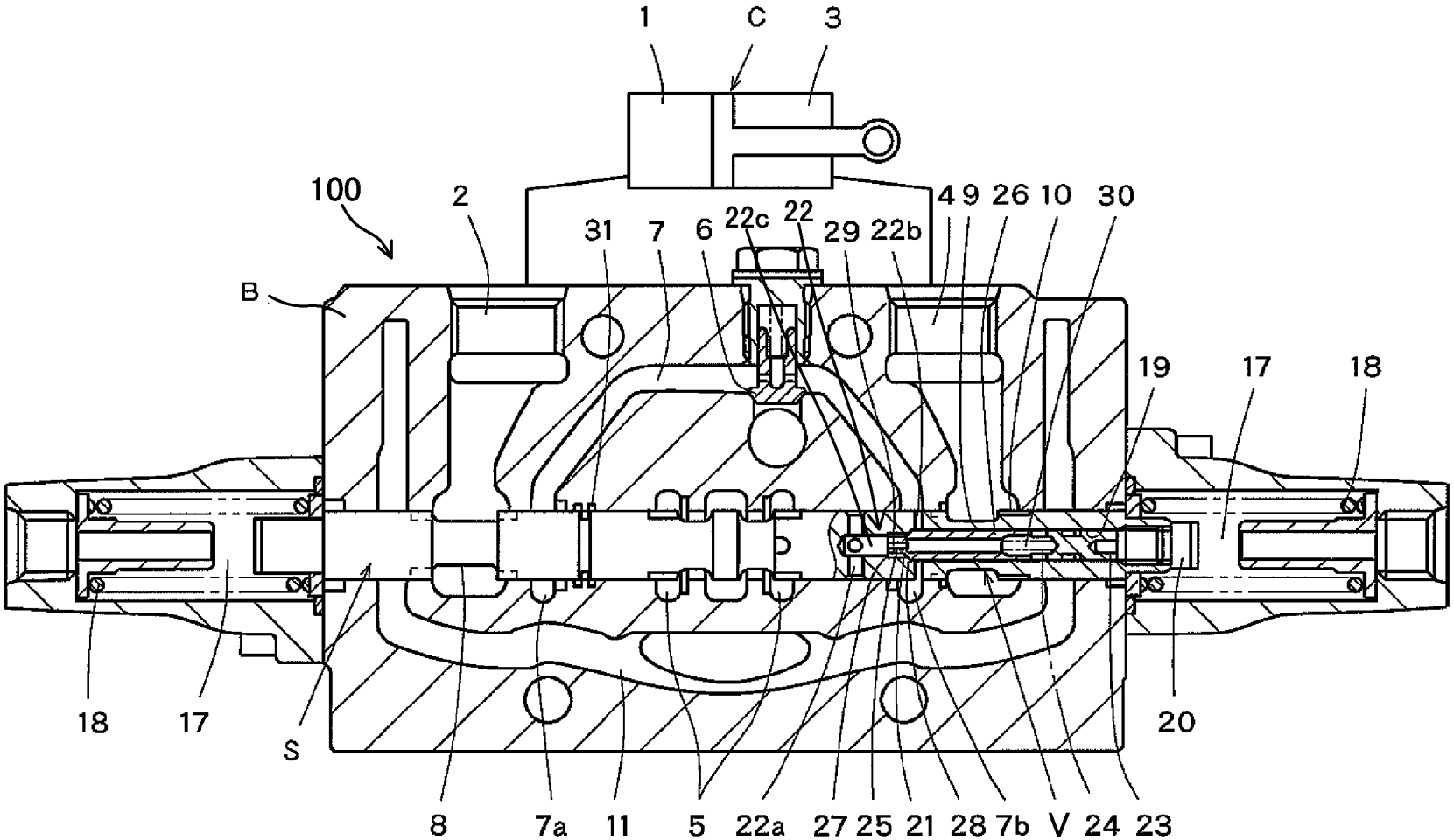
FIG. 1 is a sectional view showing a spool of a switching valve according to an embodiment of the present invention when held in a neutral position.

An embodiment of the present invention will be described below with reference to the figures.

First, referring to FIG. 7, a switching valve 200 according to a comparative example of the present invention will be described in order to facilitate comprehension of a switching valve 100 according to this embodiment of the present invention.

The switching valve 200 shown in FIG. 7 includes a spool S incorporated into a valve body B to be free to slide, a cylinder port 2 formed in the valve body B and connected to a piston side chamber 1 of a cylinder C, and a cylinder port 4 formed in the valve body B and connected to a rod side chamber 3. A pump port 5 that communicates with a pump, not shown in the figure, is formed in the valve body B. A pressure fluid led into the pump port 5 passes through a passage, not shown in the figure, and is led into a bridge passage 7 via a load check valve 6.

The bridge passage 7 includes a pair of openings. A first opening 7*a* is adjacent to the cylinder port 2, and a second opening 7*b* is adjacent to the cylinder port 4. When the spool S is in a neutral position shown in FIG. 7, communication between the bridge passage 7 and the two cylinder ports 2, 4 is kept blocked. When the spool S is switched in a rightward direction in the figure from the neutral position, the first opening 7*a* of the bridge passage 7 communicates with the cylinder port 2 via a first annular groove 8 formed in the spool S, while the cylinder port 4 and a tank passage 11 communicate with each other via a second annular groove 9 and a choke groove 10.

Accordingly, pressure fluid from the pump is supplied to the piston side chamber 1 of the cylinder C, and return fluid from the rod side chamber 3 is led into the tank passage 11 such that the cylinder C expands. Further, when the spool S is switched in the rightward direction in the figure from the neutral position, as described above, the cylinder port 4 communicates with the tank passage 11 via the choke groove 10. As a result, pressure loss is generated by the choke groove 10, leading to a corresponding increase in pressure in the cylinder port 4.

A connecting hole 12 is formed in the spool S to extend along an axial center thereof, and a first drilled hole 13 is formed in a cylinder port 4 side tip end part of the connecting hole 12. When the spool S is in the neutral position, the first drilled hole 13 opens onto the second opening 7*b* of the bridge passage 7. When the spool S moves in the rightward direction from the neutral position, the first drilled hole 13 opens onto the cylinder port 4.

A check valve 14 is incorporated into an end portion of the connecting hole 12 on an opposite side to the end portion in which the first drilled hole 13 is formed. When the check valve 14 opens, a second drilled hole 15 provided adjacent to the first annular groove 8 communicates with the connecting hole 12. In other words, the check valve 14 allows fluid to flow only from the first drilled hole 13 into the second drilled hole 15 through the connecting hole 12.

When the spool S is in the neutral position, the second drilled hole 15 is positioned between the cylinder port 2 and the first opening 7*a* in the bridge passage 7 and thereby held in a blocked condition. When the spool S is switched in the rightward direction in the figure from this condition, the second drilled hole 15 communicates with the first annular groove 8 via the first opening 7*a* in the bridge passage 7. Further, when the spool S is switched in the rightward direction, the second drilled hole 15 communicates with the first opening 7*a* in the bridge passage 7 via a recessed portion 16.

In the switching valve 200, when the spool S is switched in the rightward direction in the figure from the neutral position shown in FIG. 7, pressure fluid from the pump port 5 passes through a passage, not shown in the figure, and pushes open the load check valve 6 so as to be led into the bridge passage 7. The pressure fluid is then supplied from the cylinder port 2 into the piston side chamber 1 of the cylinder C via the first annular groove 8. It should be noted that at this time, the second drilled hole 15 is open to the bridge passage 7. Return fluid from the rod side chamber 3 of the cylinder C is led into the tank passage 11 via the choke groove 10. Further, the first drilled hole 13 is open to the cylinder port 4.

When the cylinder port 4 communicates with the tank passage 11 via the choke groove 10 in this manner, pressure loss occurs in the fluid passing through the choke groove 10, leading to an increase in the pressure in the cylinder port 4. High-pressure fluid increased in pressure in the cylinder port 4 passes through the first drilled hole 13 and the connecting hole 12, and then pushes open the check valve 14 so as to be supplied into the bridge passage 7 through the second drilled hole 15. As a result, the return fluid from the rod side chamber 3 of the cylinder C is regenerated to the piston side chamber 1 of the cylinder C.

In the switching valve 200, the return fluid from the rod side chamber 3 of the cylinder C is regenerated via the connecting hole 12 formed in the spool S. However, restrictions apply to a sectional area and so on of the spool S, making it difficult to increase a diameter of the connecting hole 12. The first and second annular grooves 8, 9 and the first drilled hole 13 are formed in the spool S, and therefore, when the diameter of the connecting hole 12 is increased, a sectional area of a part in which the first and second annular grooves 8, 9 and the first drilled hole 13 are formed decreases, leading to a strength deficiency. In a case where it is difficult to increase the diameter of the connecting passage 12 in this manner, pressure loss in the fluid passing through the connecting passage 12 increases, leading to a corresponding increase in the pressure in the rod side chamber 3. When the pressure in the rod side chamber 3 increases, the pressure in the piston side chamber 1 also increases, and therefore a discharge pressure of the pump must be increased correspondingly. As a result, an increase in energy consumption occurs.

Next, referring to FIGS. 1 to 4, a configuration of the switching valve 100 according to this embodiment will be described. The switching valve 100 has an identical valve body configuration to the switching valve 200, and also includes common parts in the spool. Hence, constituent elements in the valve body and the spool that are identical to those of the switching valve 200 according to the comparative example of the present invention will be described using identical reference symbols.

The switching valve 100 controls an operation of the cylinder C by switching between supply and discharge of a working fluid such as working oil to and from the cylinder C. The switching valve 100 is used in a construction machine or the like having a function for regenerating return fluid in the rod side chamber 3 of the cylinder C.

The switching valve 100 includes the spool S incorporated into the valve body B to be free to slide, the cylinder port 2 formed in the valve body B and connected to the piston side chamber 1 of the cylinder C, and the cylinder port 4 formed in the valve body B and connected to the rod side chamber 3. The pump port 5 communicating with the pump, not shown in the figure, is formed in the valve body B. The pressure fluid led into the pump port 5 passes through the passage not shown in the figures, and is led into the bridge passage 7 via the load check valve 6.

Figure 3:
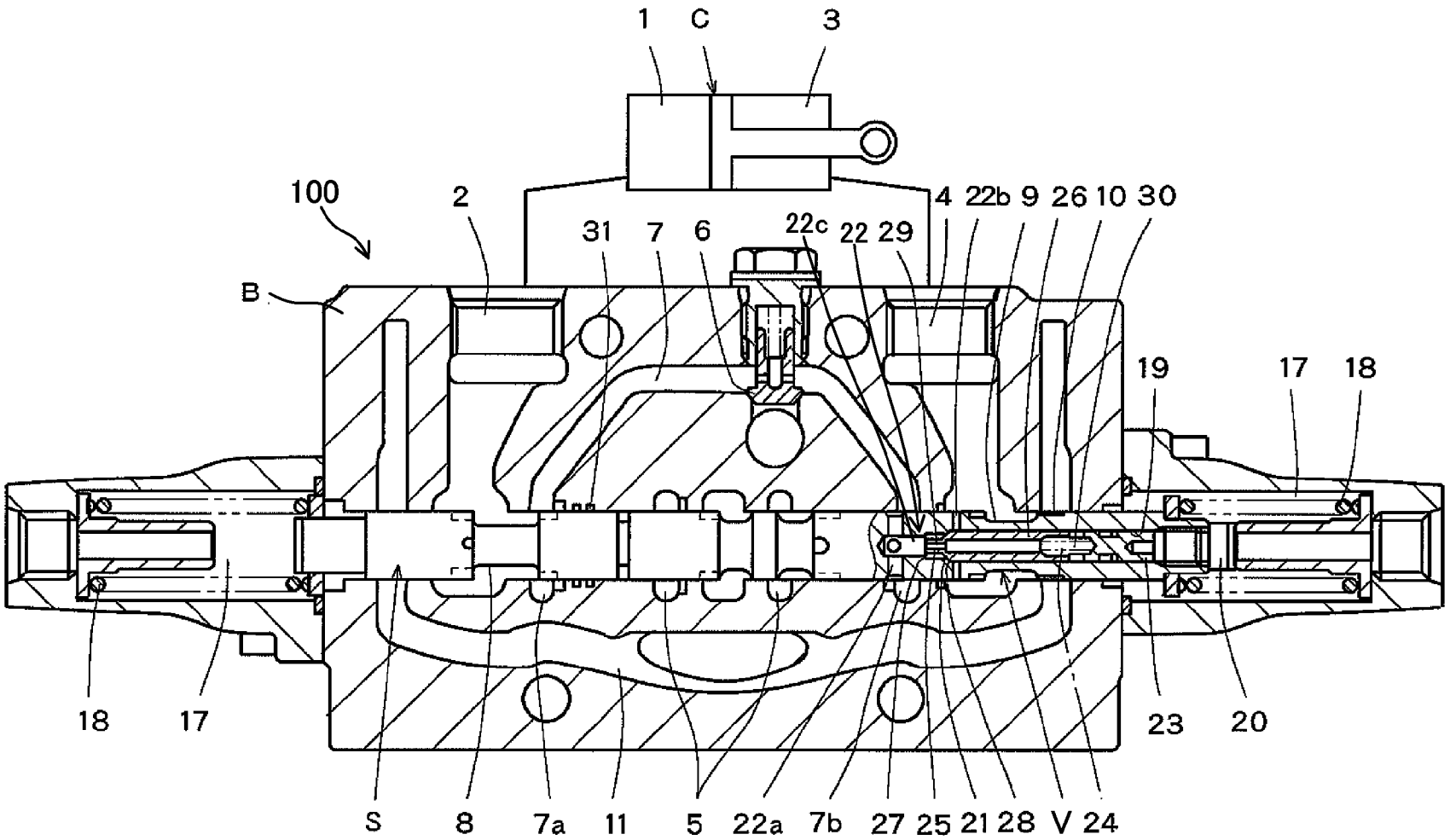
FIG. 3 is a sectional view showing the spool of the switching valve according to this embodiment of the present invention when switched to a right side position.

The bridge passage 7 includes the pair of openings, the first opening 7*a* of which is adjacent to the cylinder port 2 and the second opening 7*b* of which is adjacent to the cylinder port 4. When the spool S is in a neutral position shown in FIG. 1, communication between the bridge passage 7 and the two cylinder ports 2, 4 is kept blocked. When, as shown in FIG. 3, the spool S is switched in a rightward direction in the figure from the neutral position, the first opening 7*a* of the bridge passage 7 communicates with the cylinder port 2 via the first annular groove 8 formed in the spool S, while the cylinder port 4 and the tank passage 11 communicate with each other via the second annular groove 9 and the choke groove 10.

Accordingly, the pressure fluid from the pump is supplied to the piston side chamber 1 of the cylinder C, and the return fluid from the rod side chamber 3 is led into the tank passage 11 via the second annular groove 9 and the choke groove 10 such that the cylinder C expands. The cylinder port 4 communicates with the tank passage 11 via the choke groove 10, and therefore pressure loss is generated by the choke groove 10, leading to a corresponding increase in the pressure in the cylinder port 4. The reason for increasing the pressure on the cylinder port 4 side by providing the choke groove 10 in this manner is to introduce a regeneration flow, to be described below, into the cylinder port 2 of the cylinder C. The switching valve 100 includes pilot chambers 17, 17 facing respective end portions of the spool S, and centering springs 18, 18 provided respectively in the pilot chambers 17, 17. By introducing a pilot pressure into one of the pilot chambers 17, 17, the position of the spool S is switched. The centering springs 18, 18 bias the spool S such that when the pilot pressure is not exerted on either of the pilot chambers 17, 17, the spool S is held in the neutral position.

An incorporation hole 19 for incorporating a single direction flow valve V is formed in the spool S from a right end of the figure, which serves as a front end of a movement direction of the spool S when the spool S moves in a regeneration direction, i.e. the rightward direction in the figure. An opening portion of the incorporation hole 19 is blocked by a plug 20. By forming the incorporation hole 19 from the front end of the direction in which the spool S moves during regeneration in this manner, an axial direction length of the incorporation hole can be shortened in comparison with a case where the incorporation hole is formed from an opposite side, for example.

Figure 4:
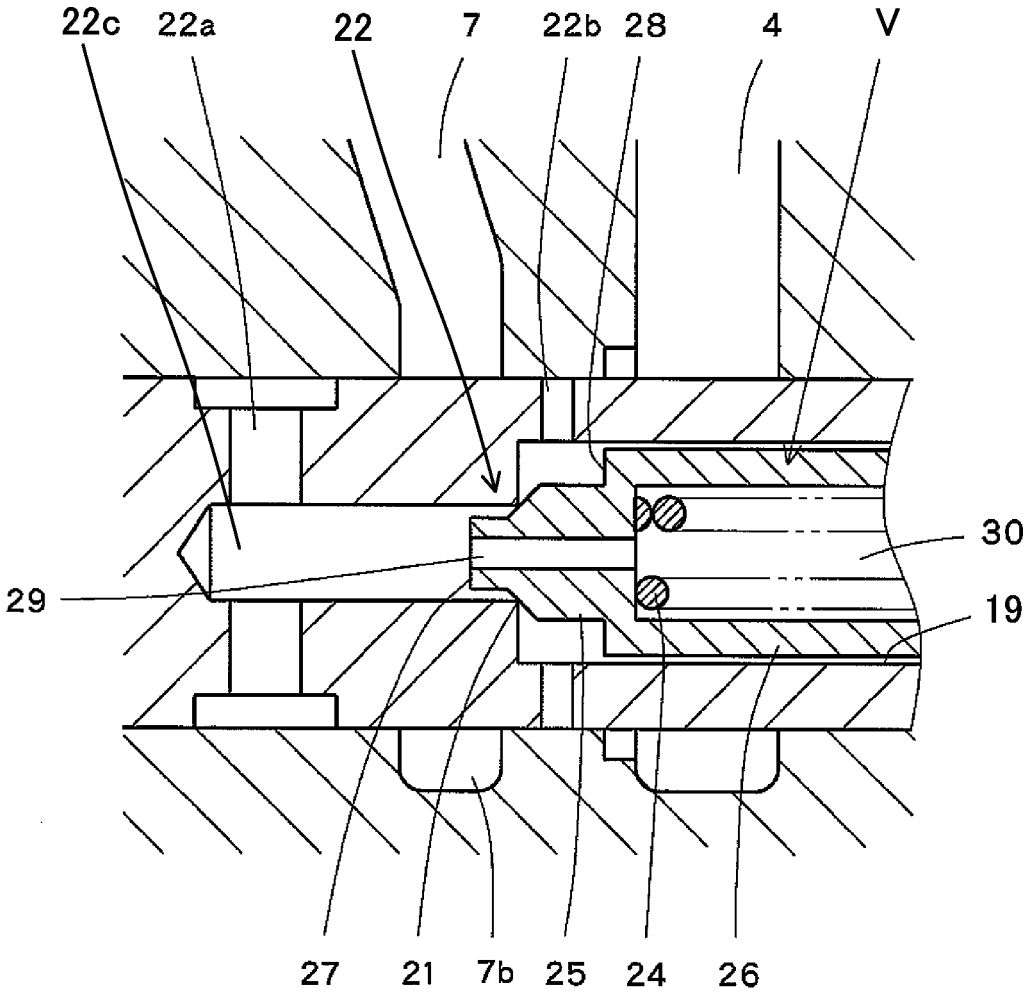
FIG. 4 is a partial enlarged sectional view showing a single direction flow valve of the switching valve according to this embodiment of the present invention.

Further, as shown in FIG. 4, the spool S includes a seat portion 21 formed in a bottom portion of the incorporation hole 19, and a connecting passage 22*c* formed in an axial direction from the seat portion 21. The single direction flow valve V is incorporated between the plug 20 and the seat portion 21.

The spool S includes, on either side of the seat portion 21, a first communication port 22*a* formed on the pump port 5 side to communicate with the connecting passage 22*c*, and a second communication port 22*b* that communicates with an incorporation passage 19 on an opposite side to the first communication port 22*a*. The first communication port 22*a* and the second communication port 22*b* are opened in an outer peripheral surface of the spool S. When the spool S is in the neutral position shown in FIG. 1, the first communication port 22*a* is positioned between the pump port 5 and the cylinder port 4 such that the opening in the outer peripheral surface of the spool S is held in a closed condition. Meanwhile, when the spool S is in the neutral position shown in FIG. 1, the second communication port 22*b* communicates with the second opening 7*b* in the bridge passage 7. It should be noted that the first communication port 22*a* remains in an incommunicative positional relationship with the pump port 5 even when the spool S is switched to a left side position, as shown in FIG. 2.

When the spool S is switched to a right side position, as shown in FIG. 3, the first communication port 22*a* communicates with the second opening 7*b* in the bridge passage 7, and the second communication port 22*b* communicates with the cylinder port 4. Here, a timing at which the second communication port 22*b* communicates with the cylinder port 4 when the spool S is switched to the right side position is set to be earlier than a timing at which the first communication port 22*a* communicates with the second opening 7*b* in the bridge passage 7.

A spacer 23 is provided in the incorporation hole 19, and a spring 24 is interposed between the spacer 23 and the single direction flow valve V. The single direction flow valve V includes a poppet portion 25 that contacts the seat portion 21, a fitting portion 26 that has a larger diameter than the poppet portion 25 and is fitted into the incorporation hole 19, and a projecting portion 27 provided on a tip end of the poppet portion 25. The single direction flow valve V is configured such that normally, the poppet portion 25 contacts the seat portion 21 such that the seat portion 21 is closed.

The fitting portion 26 is fitted into the incorporation hole 19 to be free to slide, and a fitting length of the fitting portion 26 relative to the incorporation hole 19 is set to be considerably greater than an outer diameter of the fitting portion 26. Thus, the single direction flow valve V can operate with stability. Further, an outer diameter of the poppet portion 25 is smaller than the outer diameter of the fitting portion 26 such that a step portion 28 is formed in a boundary part between the poppet portion 25 and the fitting portion 26.

The projecting portion 27 is formed to project further toward the first communication port 22*a* than the seat portion 21 when the single direction flow valve V closes the seat portion 21, whereby the projecting portion 27 is housed in the connecting passage 22*c*. A through hole 29 is formed in the projecting portion 27 and the poppet portion 25 to penetrate respective centers thereof. Further, a back pressure chamber 30 that communicates with the through hole 29 and houses the spring 24 is formed in the single direction flow valve V. The back pressure chamber 30 is formed such that when the single direction flow valve V closes the seat portion 21, a pressure receiving surface area of the back pressure chamber 30 is larger than a pressure receiving surface area of the step portion 28. Accordingly, pressure fluid flowing in through the first communication port 22*a* flows into the back pressure chamber 30 housing the spring 24 through the through hole 29, whereby the pressure of the fluid led into the back pressure chamber 30 acts on the single direction flow valve V in a direction for closing the seat portion 21.

Hence, in this embodiment, the first communication port 22*a* and the second communication port 22*b* communicate with each other via the incorporation hole 19, the seat portion 21, and the connecting passage 22*c*. Further, in this embodiment, a passage linking the first communication port 22*a* to the second communication port 22*b* serves as a regeneration passage 22. In other words, the incorporation hole 19, the seat portion 21, and the connecting passage 22*c* constituting the passage linking the first communication port 22*a* to the second communication port 22*b* together function as the regeneration passage 22. More specifically, a passage formed from the incorporation hole 19 and the single direction flow valve V, the seat portion 21, and the connecting passage 22*c* constitute the regeneration passage 22. Furthermore, a signal passage 31 is provided on an opposite side of the valve body B to the regeneration passage 22.

Next, actions of the switching valve 100 according to this embodiment will be described.

Figure 2:
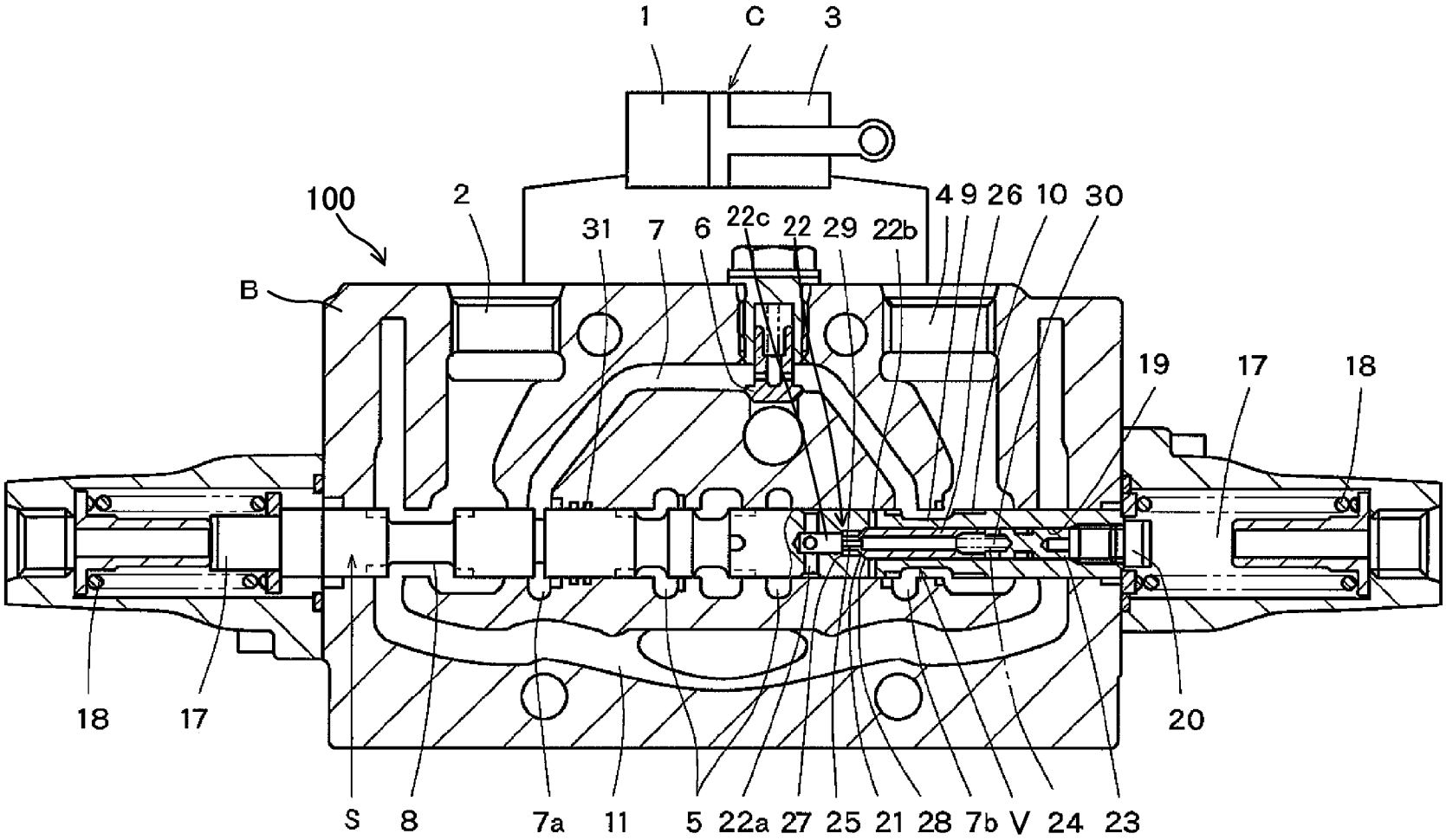
FIG. 2 is a sectional view showing the spool of the switching valve according to this embodiment of the present invention when switched to a left side position.

When the spool S is switched from the neutral position shown in FIG. 1 to the left side position shown in FIG. 2, the first opening 7*a* is blocked, while the second opening 7*b* in the bridge passage 7 communicates with the cylinder port 4 via the second annular groove 9 and the cylinder port 2 communicates with the tank passage 11 via the first annular groove 8. As a result, the pressure fluid that pushes open the load check valve 6 from the pump port 5 so as to be led into the bridge passage 7 is led into the rod side chamber 3 of the cylinder C via the cylinder port 4. Further, the return fluid from the piston side chamber 1 of the cylinder C is led into the tank passage 11 from the cylinder port 2, and therefore the cylinder C contracts.

When the spool S is switched to the right side position shown in FIG. 3, the first opening 7*a* of the bridge passage 7 communicates with the cylinder port 2 via the first annular groove 8, and therefore the pressure fluid led into the bridge passage 7 from the pump port 5 is led into the piston side chamber 1 of the cylinder C via the cylinder port 2. Further, at this time, a part of the return fluid from the rod side chamber 3 flows into the tank passage 11 via the choke groove 10, and therefore the pressure on the cylinder port 4 side increases relatively.

As described above, during the process in which the spool S is switched to the right side position, the second communication port 22*b* communicates with the cylinder port 4, and at a slight delay relative to the communication timing of the second communication port 22*b*, the first communication port 22*a* communicates with the second opening 7*b* in the bridge passage 7. When the second communication port 22*b* communicates with the cylinder port 4, the relatively increased pressure on the cylinder port 4 side acts on the step portion 28 of the single direction flow valve V. Then, at a slightly delayed timing, the first communication port 22*a* communicates with the second opening 7*b* in the bridge passage 7.

Hence, a pump pressure introduced from the second opening 7*b* in the bridge passage 7 acts within the back pressure chamber 30, while the relatively high pressure in the cylinder port 4 acts on the step portion 28, and therefore the single direction flow valve V opens the seat portion 21 against the spring 24. When the seat portion 21 is opened, the return fluid led into the cylinder port 4 is led into the bridge passage 7 through the second communication port 22*b*, the regeneration passage 22, and the first communication port 22*a*.

It should be noted that since the projecting portion 27 is formed on the tip end of the poppet portion 25, a throttle effect is exhibited between the projecting portion 27 and the incorporation hole 19, and therefore a situation in which the pressure on the cylinder port 4 side becomes too low such that the single direction flow valve V closes the seat portion 21 does not arise.

The fluid led into the bridge passage 7 converges with the pressure fluid from the pump port 5 and is supplied thus to the piston side chamber 1 of the cylinder C. In other words, the return fluid in the rod side chamber 3 of the cylinder C is regenerated to the piston side chamber 1.

Figure 5:
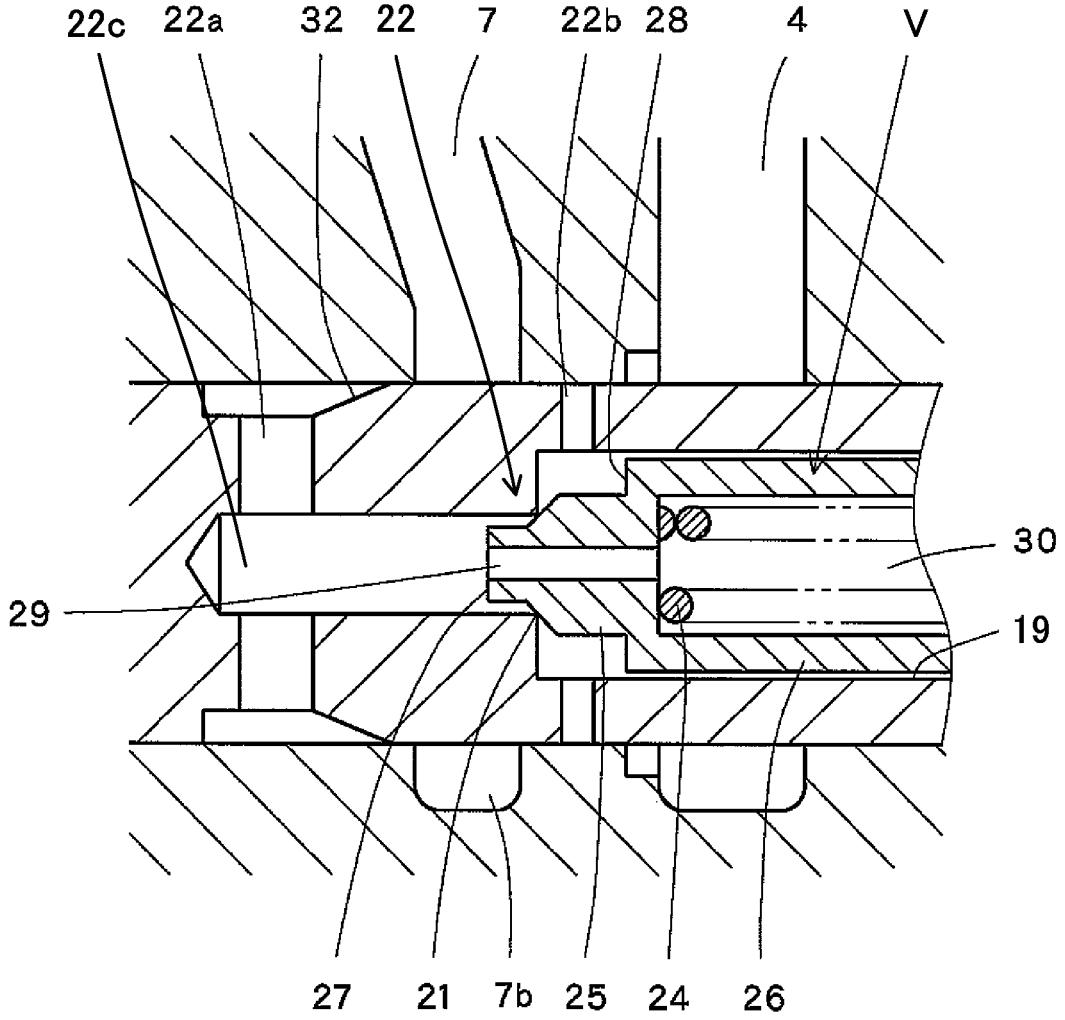
FIG. 5 is a partial enlarged sectional view showing a single direction flow valve of the switching valve according to another embodiment of the present invention.
Figure 6:
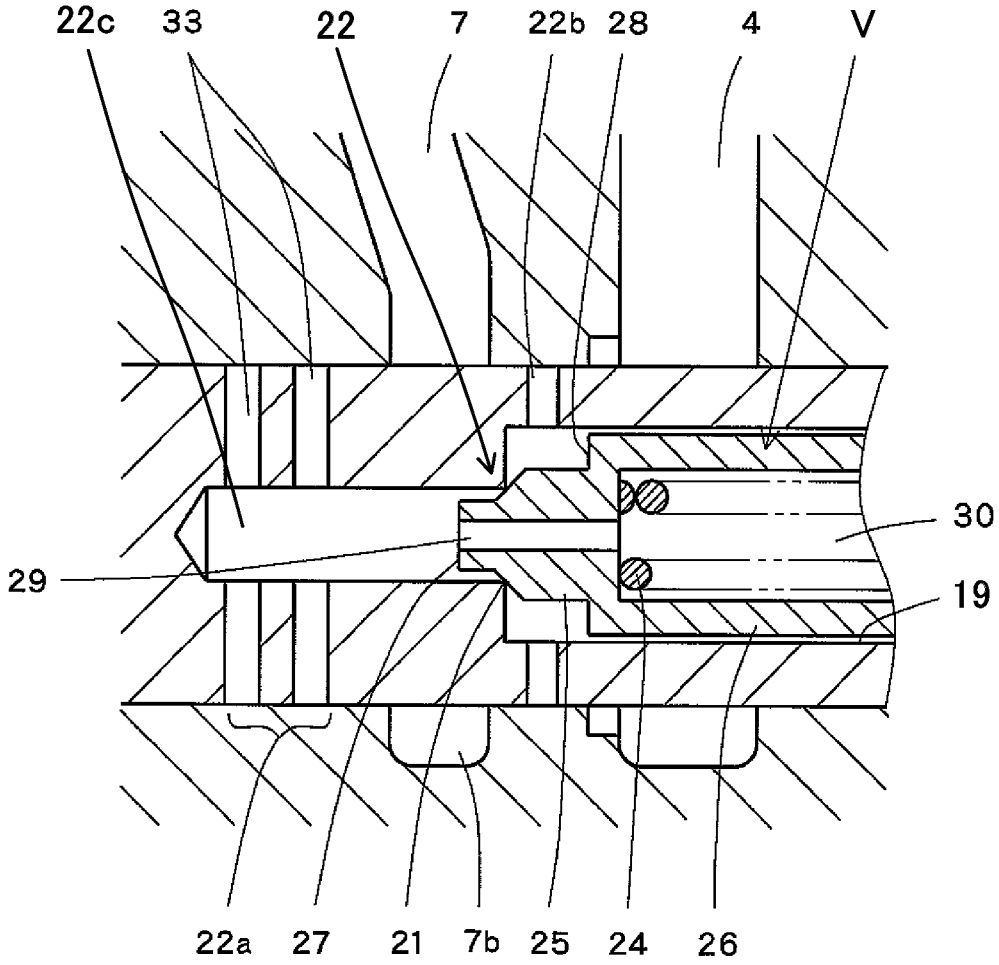
FIG. 6 is a partial enlarged sectional view showing a single direction flow valve of the switching valve according to a further embodiment of the present invention.

It should be noted that an opening portion of the first communication port 22*a* according to this embodiment is a circular hole, but instead, as shown in FIG. 5, for example, the first communication port 22*a* may be constituted by a variable communication port having a variable opening by forming a tapered portion 32 that increases gradually in depth from a front side to a rear side of the direction in which the spool S moves to connect the first communication port 22*a* to the second opening 7*b* of the bridge passage 7. Further, as shown in FIG. 6, instead of the tapered portion 32, the variable communication port may be constituted by a plurality of connecting holes 33 arranged from the front side to the rear side of the direction in which the spool S moves to connect the first communication port 22*a* to the second opening 7*b* of the bridge passage 7.

According to the embodiment described above, following effects are obtained.

In the switching valve 100 according to this embodiment, the cylinder port 4 and the second opening 7*b* of the bridge passage 7 communicate with each other via the regeneration passage 22, and therefore the return fluid from the rod side chamber 3 of the cylinder C is led into the cylinder port 2 through the bridge passage 7 and then regenerated to the piston side chamber 1 of the cylinder C. A sectional area of the bridge passage 7 can be made considerably larger than that of the connecting hole 12 formed conventionally in the spool S. In other words, pressure loss can be reduced in comparison with a case where the return fluid passes through the small-diameter connecting hole 12, enabling a reduction in a flow passage resistance during regeneration of the return fluid. As a result, the pressure in the rod side chamber 3 during regeneration can be reduced relatively, enabling a reduction in a load exerted on the pump, not shown in the figures, and a corresponding reduction in energy consumption.

Furthermore, the single direction flow valve V is provided, and therefore, when the switching valve 100 according to this embodiment is used in a construction machine, for example, the pressure in the rod side chamber 3 can be kept low during an excavation operation in which the pressure in the piston side chamber 1 must be kept high and the pressure in the rod side chamber 3 must be kept low. If, during the excavation operation, the pump side pressure opens the single direction flow valve V and flows into the rod side chamber 3, the discharge pressure of the pump acts on the rod side chamber 3, leading to a reduction in the efficiency of the excavation operation. With the switching valve 100 according to this embodiment, however, the pressure in the rod side chamber 3 is kept low by providing the single direction flow valve V, as described above, and therefore the efficiency of the excavation operation does not deteriorate.

Furthermore, when the spool S is switched, the timing at which the second communication port 22*b* communicates with the cylinder port 4 is set to be earlier than the timing at which the first communication port 22*a* communicates with the second opening 7*b* of the bridge passage 7, and therefore, at the start of regeneration for regenerating the return fluid from the rod side chamber 3, the pressure of the return fluid acts on the single direction flow valve V before the first communication port 22*a* opens in the bridge passage 7. Hence, the single direction flow valve V opens at the same time as the first communication port 22*a* communicates with the bridge passage 7, leading to an improvement in a responsiveness of the single direction flow valve V.

Moreover, the first communication port 22*a* is formed in a position where the first communication port 22*a* does not communicate with the pump port 5, which is formed in the valve body B and into which the pressure fluid from the pump is introduced, regardless of the position of the spool S. Since the first communication port 22*a* does not communicate with the pump port 5, the pressure fluid from the pump port 5 can be reliably prevented from flowing back into the regeneration passage 22. When the pressure fluid from the pump port 5 flows back into the regeneration passage 22, the switching valve 100 becomes unable to control the cylinder C, but with the switching valve 100 according to this embodiment, no loss of control occurs.

Further, by forming the first communication port 22*a* from a variable communication port, a communication opening with the bridge passage 7 can be increased gradually during the movement process of the spool S, and therefore the pressure in the bridge passage 7 can be prevented from increasing rapidly. As a result, a shock exerted on the cylinder C can be alleviated.

Furthermore, the incorporation hole 19 for incorporating the single direction flow valve V is formed in the spool S from the front end of the movement direction in which the spool S moves during regeneration, and therefore the axial direction length of the incorporation hole 19 can be shortened, thereby facilitating hole formation.

Moreover, the single direction flow valve V is provided to open and close the seat portion 21 formed in the incorporation hole 19, and in a condition where the seat portion 21 is closed by the single direction flow valve V, the pressure receiving surface area on which the second communication port 22*b* side pressure is received is larger than the pressure receiving surface area on which the first communication port 22*a* side pressure is received. The seat portion 21 is therefore opened by an action of the second communication port 22*b* side pressure, whereby the fluid flowing in from the cylinder port 4 side is led into the bridge passage 7. By inserting the single direction flow valve V from the open end of the incorporation hole 19 in this manner, a single direction flow control function can be realized.

Further, the projecting portion 27 is formed on the single direction flow valve V, and therefore, even when the single direction flow valve V is fully open, flow passage resistance can be maintained in relation to the fluid during regeneration. As a result, the pressure in the rod side chamber 3 of the cylinder C can be maintained at an appropriate level.

Furthermore, the axial direction fitting length of the single direction flow valve V relative to the incorporation hole 19 is greater than the diameter of the fitting portion 26, and therefore the single direction flow valve V can be incorporated in a stable condition.

Embodiments of this invention were described above, but the above embodiments are merely examples of applications of this invention, and the technical scope of this invention is not limited to the specific constitutions of the above embodiments.

This application claims priority based on Japanese Patent Application No. 2012-180235 filed with the Japan Patent Office on Aug. 15, 2012, the entire contents of which are incorporated into this specification.

The invention claimed is:

1. A switching valve that switches between supply and discharge of a working fluid to and from a cylinder having a piston side chamber and a rod side chamber, comprising:

a valve body;

a spool incorporated into the valve body to be free to slide relative to the valve body, the spool having an incorporation hole formed in the spool to extend along an axial direction of the spool;

a first cylinder port in the valve body that communicates with the piston side chamber;

a second cylinder port in the valve body that communicates with the rod side chamber;

a bridge passage in the valve body, the bridge passage having a pair of openings, a first opening of which is adjacent to the first cylinder port and a second opening of which is adjacent to the second cylinder port;

a first communication port and a second communication port formed in the spool, the second communication port opening into the incorporation hole, such that the incorporation hole comprises a part of a regeneration passage formed in the spool between the first communication port and the second communication port, the regeneration passage connecting the second cylinder port communicating with the rod side chamber to the first cylinder port, based on a switching position of the spool;

a single direction flow valve provided in the incorporation hole of the regeneration passage, the single direction flow valve being configured to only permit a flow from the second cylinder port to the second opening in the bridge passage; and a choke groove formed in the spool, a communication between a tank passage through which discharged working fluid pass and the second cylinder port is controlled by the choke groove when the spool moves in a regeneration direction for connecting the first communication port to the second opening in the bridge passage, wherein the spool is slideable relative to the valve body along axis, such that when the spool slides in a first direction, the single direction flow valve is closed, and when the spool slides in a second direction corresponding to the regeneration direction, the single direction flow valve is opened and the flow is permitted from the second cylinder port to the second opening in the bridge passage, wherein the second communication port is located in the second direction relative to the first communication port, wherein the incorporation hole opens at an end surface of the spool located in the second direction relative to the second communication port, wherein the first communication port communicates with the second opening of the bridge passage, which is adjacent to the second cylinder port, and the second communication port communicates with the second cylinder port in accordance with the switching position of the spool.

2. The switching valve as defined in claim 1, wherein, when the spool is switched, a timing at which the second communication port communicates with the second cylinder port is earlier than a timing at which the first communication port communicates with the second opening in the bridge passage.

3. The switching valve as defined in claim 1, wherein the first communication port has a tapered opening, such that a depth of a portion of the opening increases gradually in an axial direction of the spool from an outer edge of the opening towards a center of the opening.

4. The switching valve as defined in claim 1, wherein the first communication port is constituted by a plurality of connecting holes arranged so as to be spaced apart from each other along the axial direction of the spool.

5. The switching valve as defined in claim 1, wherein the single direction flow valve opens and closes a seat portion formed in the incorporation hole, and in a condition where the seat portion is closed by the single direction flow valve, a pressure receiving surface area of a surface that receives a pressure on the second communication port side is larger than a pressure receiving surface area of a surface that receives a pressure on the first communication port side.

6. The switching valve as defined in claim 5, wherein the single direction flow valve includes a projecting portion that projects from the seat portion toward the first communication port side.

7. The switching valve as defined in claim 1, wherein the single direction flow valve is incorporated into the incorporation hole by being fitted therein, and an axial direction fitting length of the single direction flow valve relative to the incorporation hole is greater than a diameter of a fitted part of the single direction flow valve.

8. A switching valve that switches between supply and discharge of a working fluid to and from a cylinder having a piston side chamber and a rod side chamber, comprising:

a spool incorporated into a valve body to be free to slide;

a first cylinder port that communicates with the piston side chamber;

a second cylinder port that communicates with the rod side chamber;

a bridge passage having a pair of openings, a first opening of which is adjacent to the first cylinder port and a second opening of which is adjacent to the second cylinder port;

a regeneration passage formed in the spool allowing the second cylinder port communicating with the rod side chamber to communicate with the first cylinder port in accordance with a switching position of the spool; and a first communication port and a second communication port formed in the spool to communicate with the regeneration passage, wherein the first communication port communicates with the second opening of the bridge passage, which is adjacent to the second cylinder port, the second communication port communicates with the second cylinder port in accordance with the switching position of the spool, a pump port into which pressure fluid from a pump is introduced is formed in the valve body, and the first communication port does not communicate with the pump port regardless of a stroke direction of the spool.

* * * * *